US008631963B2

(12) United States Patent
Lane et al.

(10) Patent No.: US 8,631,963 B2
(45) Date of Patent: Jan. 21, 2014

(54) SIDE ACTION INSERT/SKELETAL STIFFENING RIBS

(75) Inventors: Michael T. Lane, Brooklyn, MI (US); Brad Wilson, Manchester, MI (US)

(73) Assignee: Amcor Limited, Hawthorn (AU)

( * ) Notice: Subject to any disclaimer, the term of this patent is extended or adjusted under 35 U.S.C. 154(b) by 0 days.

(21) Appl. No.: 13/185,528

(22) Filed: Jul. 19, 2011

(65) Prior Publication Data

US 2012/0018440 A1 Jan. 26, 2012

Related U.S. Application Data

(60) Provisional application No. 61/365,865, filed on Jul. 20, 2010.

(51) Int. Cl.
*B65D 6/38* (2006.01)
*B65D 90/02* (2006.01)

(52) U.S. Cl.
USPC ..... 220/675; 220/669; 220/671; 215/381; 215/382; 215/383

(58) Field of Classification Search
USPC ..... 215/381, 382, 383; 220/671, 669, 675, 220/23.6, 23.4, 23.2
See application file for complete search history.

(56) References Cited

U.S. PATENT DOCUMENTS

| | | | | |
|---|---|---|---|---|
| 5,381,916 | A * | 1/1995 | Strawder | 220/23.4 |
| 5,477,974 | A | 12/1995 | Reil et al. | |
| 6,112,925 | A | 9/2000 | Nahill et al. | |
| 7,267,242 | B2 | 9/2007 | Tanaka et al. | |
| 7,357,265 | B2 * | 4/2008 | Zoller | 215/6 |
| D586,225 | S * | 2/2009 | Devereaux | D9/541 |
| 2006/0261063 | A1 * | 11/2006 | Dyehouse | 220/23.4 |
| 2007/0045222 | A1 * | 3/2007 | Denner et al. | 215/382 |
| 2009/0057263 | A1 * | 3/2009 | Barker et al. | 215/381 |

FOREIGN PATENT DOCUMENTS

JP 2009-062064 3/2009

* cited by examiner

*Primary Examiner* — Anthony Stashick
*Assistant Examiner* — Don M Anderson
(74) *Attorney, Agent, or Firm* — Harness, Dickey & Pierce, P.L.C.

(57) ABSTRACT

A container comprising a finish, a sidewall portion extending from the finish, a base portion extending from the sidewall portion and enclosing the sidewall portion to form a volume therein for retaining a commodity, and an outwardly directed rib member.

18 Claims, 4 Drawing Sheets

SIDE ACTION INSERT/SKELETAL STIFFENING RIBS

CROSS-REFERENCE TO RELATED APPLICATIONS

This application claims the benefit of U.S. Provisional Application No. 61/365,865, filed on Jul. 20, 2010. The entire disclosure of the above application is incorporated herein by reference.

FIELD

This disclosure generally relates to containers for retaining a commodity, such as a solid or liquid commodity. More specifically, this disclosure relates to a container having vertically disposed stiffening ribs extending along at least a sidewall of a container.

BACKGROUND AND SUMMARY

This section provides background information related to the present disclosure which is not necessarily prior art. This section also provides a general summary of the disclosure, and is not a comprehensive disclosure of its full scope or all of its features.

As a result of environmental and other concerns, plastic containers, more specifically polyester and even more specifically polyethylene terephthalate (PET) containers are now being used more than ever to package numerous commodities previously supplied in glass containers. Manufacturers and fillers, as well as consumers, have recognized that PET containers are lightweight, inexpensive, recyclable and manufacturable in large quantities.

Blow-molded plastic containers have become commonplace in packaging numerous commodities. PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \left(\frac{\rho - \rho_a}{\rho_c - \rho_a}\right) \times 100$$

where ρ is the density of the PET material; ρa is the density of pure amorphous PET material (1.333 g/cc); and ρc is the density of pure crystalline material (1.455 g/cc).

Container manufacturers use mechanical processing and thermal processing to increase the PET polymer crystallinity of a container. Mechanical processing involves orienting the amorphous material to achieve strain hardening. This processing commonly involves stretching an injection molded PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of approximately 250° F.-350° F. (approximately 121° C.-177° C.), and holding the blown container against the heated mold for approximately two (2) to five (5) seconds. Manufacturers of PET juice bottles, which must be hot-filled at approximately 185° F. (85° C.), currently use heat setting to produce PET bottles having an overall crystallinity in the range of approximately 25%-35%.

Unfortunately, in some applications, containers are often exposed to a wide variety of manufacturing, filling, transporting, and using forces that vary greatly. Moreover, many of the containers of today much reflect a certain consumer appeal without sacrificing structural integrity and performance. In light of the increased costs of materials and transportation, there is an ever present desire to reduce materials used and the overall weight of the container. Consequently, however, any major revisions of these containers can lead to the need for revised manufacturing and transportation solutions, which can quickly consume any savings realized through container redesign and reconstruction. Therefore, in some cases, it is desirable to achieve improvements in container design that do not require the redesign and associated retooling of the existing manufacturing systems and distribution networks. Therefore, there is a need for ultra-lightweight, thin-walled containers capable of surviving existing distribution and filling systems. The principles of the present teachings provide a thin-wall container having vertical seams for topload support and standing ring seam to support the container, thus creating a rigid frame to support the container as it moves through these traditional storage, distribution, and filling systems.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
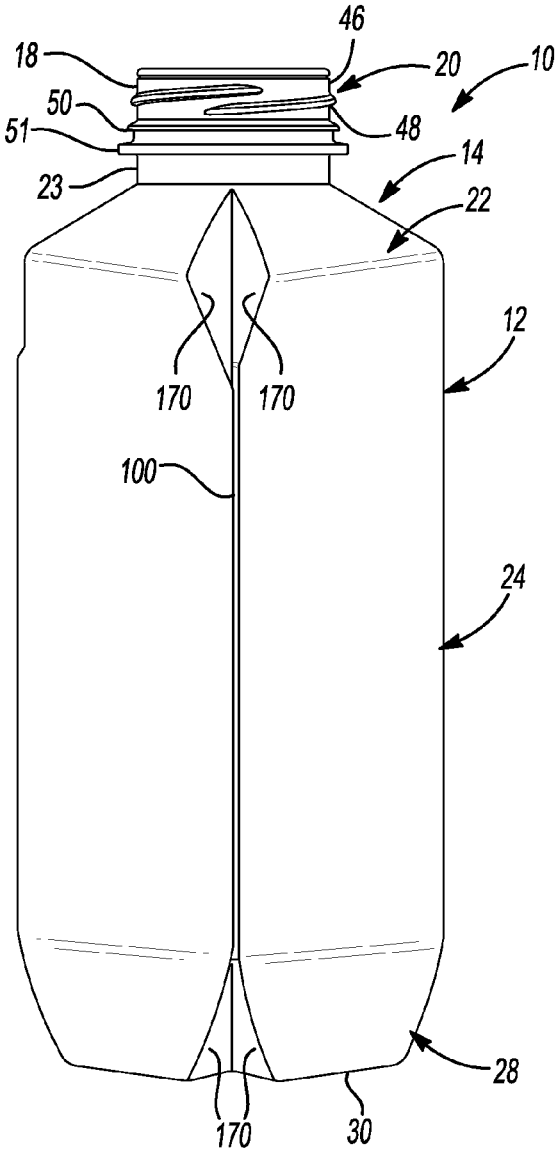
FIG. 1 is a front perspective view of an exemplary container incorporating the features of the present teachings.
Figure 2:
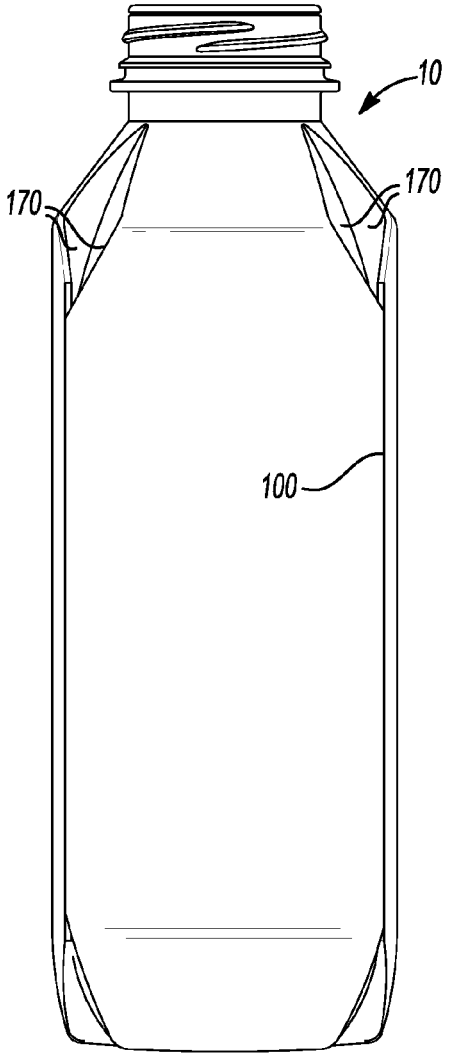
FIG. 2 is a side view of the exemplary container incorporating the features of the present teachings.
Figure 3:
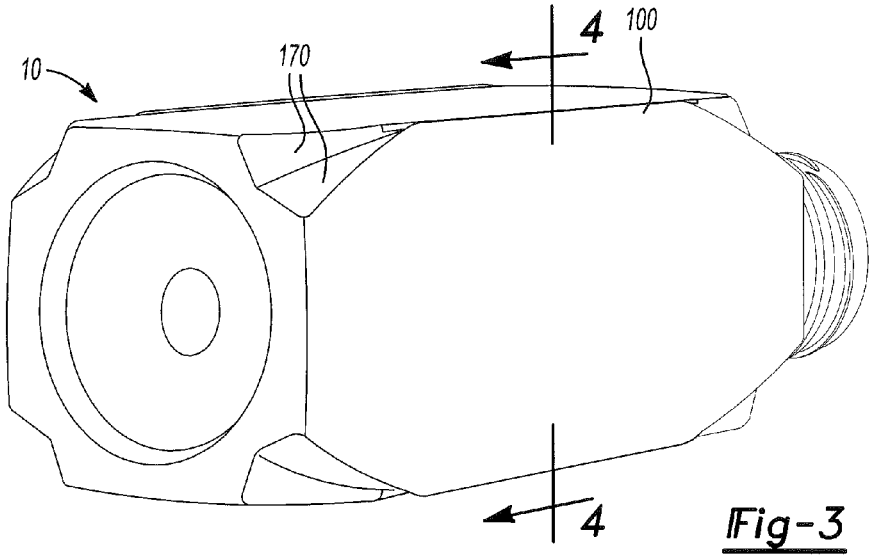
FIG. 3 is a bottom view of the exemplary container incorporating the features of the present teachings.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

This disclosure provides for a container being made of PET or other thermoplastic and incorporating one or more vertically oriented reinforcement ribs or seam features. The rib or seam features provide increased structural integrity of the container without unduly increasing its weight or preventing the manufacture, filling, transporting or general use of the container using conventional equipment and processes.

It should be appreciated that the size and specific configuration of the container may not be particularly limiting and, thus, the principles of the present teachings can be applicable to a wide variety of thermoplastic container shapes. Therefore, it should be recognized that variations can exist in the present embodiments. That is, it should be appreciated that the teachings of the present disclosure can be used in a wide variety of containers, including reusable/disposable packages including resealable containers (e.g., TupperWare® containers), dried food containers (e.g., dried milk), drug containers, chemical packaging, squeezable containers, recyclable containers, and the like.

Accordingly, the present teachings provide a plastic, e.g. polyethylene terephthalate (PET) or other thermoplastic, container generally indicated at 10. The exemplary container 10 can be substantially elongated when viewed from a side and rectangular when viewed from above. Those of ordinary skill in the art would appreciate that the following teachings of the present disclosure are applicable to other containers, such as rectangular, triangular, pentagonal, hexagonal, octagonal, polygonal, or square shaped containers, which may have different dimensions and volume capacities. It is also contemplated that other modifications can be made depending on the specific application and environmental requirements.

In some embodiments, container 10 has been designed to retain a commodity. The commodity may be in any form such as a solid or semi-solid product. In one example, a commodity may be introduced into the container during a thermal process, typically a hot-fill process. For hot-fill bottling applications, bottlers generally fill the container 10 with a product at an elevated temperature between approximately 155° F. to 205° F. (approximately 68° C. to 96° C.) and seal the container 10 with a closure before cooling. In addition, the plastic container 10 may be suitable for other high-temperature pasteurization or retort filling processes or other thermal processes as well. In another example, the commodity may be introduced into the container under ambient temperatures.

As shown in FIGS. 1-4, the exemplary plastic container 10 according to the present teachings defines a body 12, and includes an upper portion 14 having a cylindrical sidewall 18 forming a finish 20. Integrally formed with the finish 20 and extending downward therefrom is a shoulder portion 22. The shoulder portion 22 merges into and provides a transition between the finish 20 and a sidewall portion 24. The sidewall portion 24 extends downward from the shoulder portion 22 to a base portion 28 having a base 30. In some embodiments, sidewall portion 24 can extend down and nearly abut base 30, thereby minimizing the overall area of base portion 28 such that there is not a discernable base portion 28 when exemplary container 10 is uprightly-placed on a surface.

The exemplary container 10 may also have a neck 23. The neck 23 may have an extremely short height, that is, becoming a short extension from the finish 20, or an elongated height, extending between the finish 20 and the shoulder portion 22. The upper portion 14 can define an opening for filling and dispensing of a commodity stored therein. Although the container is shown as a beverage container, it should be appreciated that containers having different shapes, such as sidewalls and openings, can be made according to the principles of the present teachings.

The finish 20 of the exemplary plastic container 10 may include a threaded region 46 having threads 48, a lower sealing ridge 50, and a support ring 51. The threaded region provides a means for attachment of a similarly threaded closure or cap (not shown). Alternatives may include other suitable devices that engage the finish 20 of the exemplary plastic container 10, such as a press-fit or snap-fit cap for example. Accordingly, the closure or cap engages the finish 20 to preferably provide a hermetical seal of the exemplary plastic container 10. The closure or cap is preferably of a plastic or metal material conventional to the closure industry and suitable for subsequent thermal processing.

Figure 7:
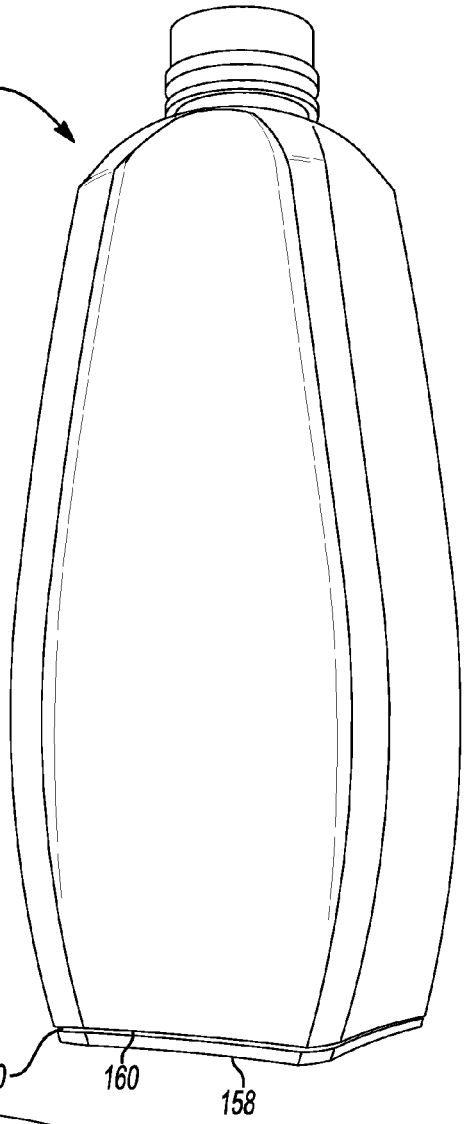
FIG. 7 is a front perspective view of an exemplary container incorporating the features of the present teachings.
Figure 8:
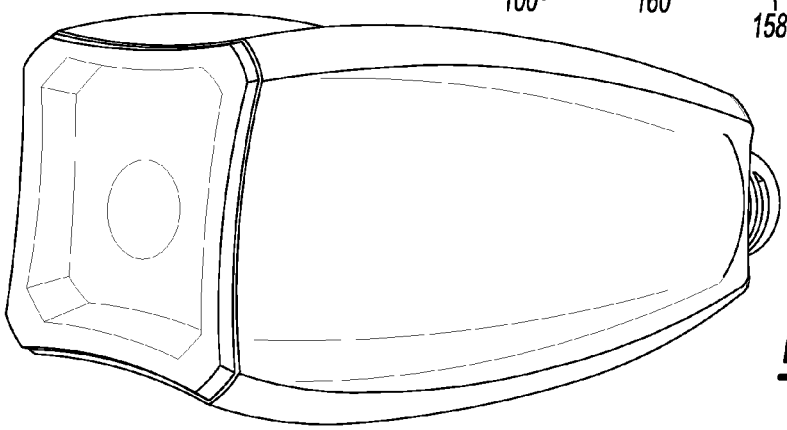
FIG. 8 is a bottom view of the exemplary container of FIG. 7 incorporating the features of the present teachings.

According to the principles of the present teachings, container 10 can comprise one or more vertically oriented reinforcing ribs or seams 100 formed in the sidewall portion 24 of container 10. In some embodiments, reinforcing ribs or seams 100 can be formed in any one or more of shoulder portion 22, sidewall portion 24, and/or base portion 28. Moreover, in some embodiments, container 10 can comprise one or more horizontally or circumferentially-disposed reinforcing ribs or seams 100 formed in at least one of the finish 20, the sidewall portion 24, or the base portion 28 of container 10 (see FIGS. 7 and 8). When used along base portion 28, ribs or seams 100 can serve a dual purpose as also a standing ring or other surface which is used to support the container 10 on a surface. As will be discussed herein, in such embodiments, ribs or seams 100 can extend along the base portion 28 such that a distal end is generally even with a plane extending along the sidewall portion 24. In some embodiments, reinforcing ribs or seams 100 are formed as a very thin rib of material extending outwardly from sidewall portion 24.

Reinforcing ribs or seams 100 can be formed during the blow-molding process. Specifically, in some embodiments, a side action mechanism within the blow mold can be used to create a vertical seam in the form of a very thin rib of material on the container sidewall or to adjust the timing of the blow mold system to create a "flashing" effect to create the vertical structure along the blow mold parting lines. That is, a side action mechanism can be actuated to draw a portion of the mold outwardly to permit material of the perform to form therein. This outward draw of the mold causes an associated outward formation in the resultant container shape, thereby forming reinforcing ribs or seams 100.

Alternatively, in some embodiments, flash can be used to create or define the reinforcing ribs and seams 100. That is, a parting line between portions of the mold can be positioned such that material that flows within this mold seams results in a narrow rib of material along the outside surface of sidewall portion 24. In this way, the narrow rib of material forms a structural reinforcing member that is provides improved structural integrity of container 10. In some embodiments, this flash material can be trimmed to a desired size and or shape; however, it should be appreciated that this is an optional processing step. In some embodiments, these principles can be combined with optional standing ring features to provide additional benefits and advantages.

In some embodiments, the principles of the present teachings can be used to manufacture stand-up-pouch-like structures that include the consumer benefits of PET bottles and improved recyclability as compared to current stand-up-pouch offerings. Additionally, the principles of the present teachings provide sufficient structural integrity to enable the container to survive existing storage, distribution, and filling infrastructure.

Figure 4:
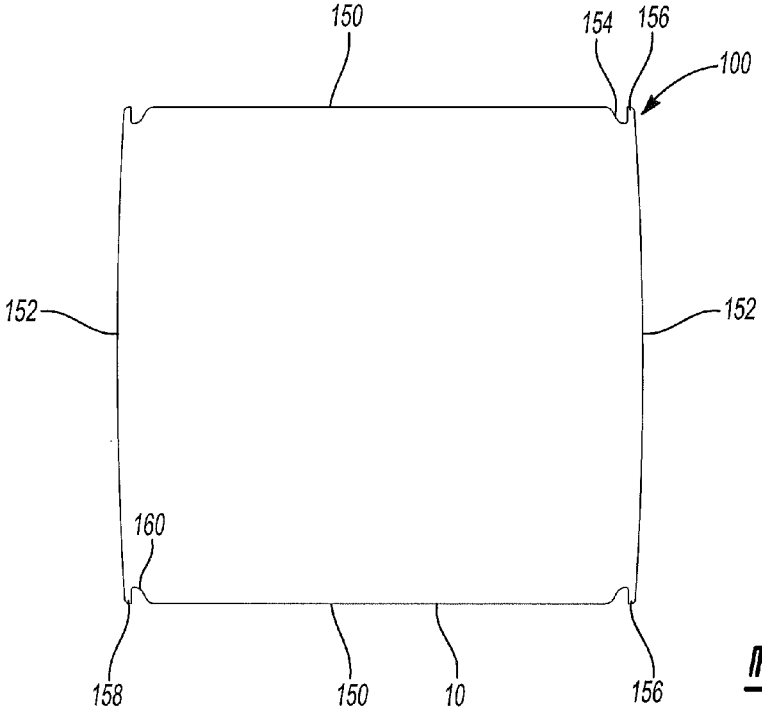
FIG. 4 is a cross-sectional view of the exemplary container of FIG. 1 incorporating the features of the present teachings.

In some embodiments, as illustrated in FIG. 4, reinforcing ribs or seams 100 can be formed at corner portions 110 of sidewall portion 24. Specifically, in some embodiments, reinforcing ribs or seams 100 can be formed such that they are viewable from alternating sides of container 10. That is, ribs or seams 100 can be viewable from sides 150, while generally concealed from sides 152. As such, ribs or seams 100 can define an inwardly directed channel 154 resulting in an outwardly directed portion 156. In some embodiments, outwardly directly portion 156 can be shaped similar to a finger having a distal tip 158. In some embodiments, as shown, distal tip 158 of outwardly directed portion 156 of reinforcing rib or seam 100 can extend along side 152 to a position generally even with adjacent side 150. This can permit labels to smoothly conform to the outermost shape of the container 10 and/or provide an unobstructive container contour that is generally pleasing to the touch. However, it should be recognized that distal tip 158 can extend along side 152 to a position beyond adjacent side 150 and/or to a position below adjacent side 150.

Figure 5:
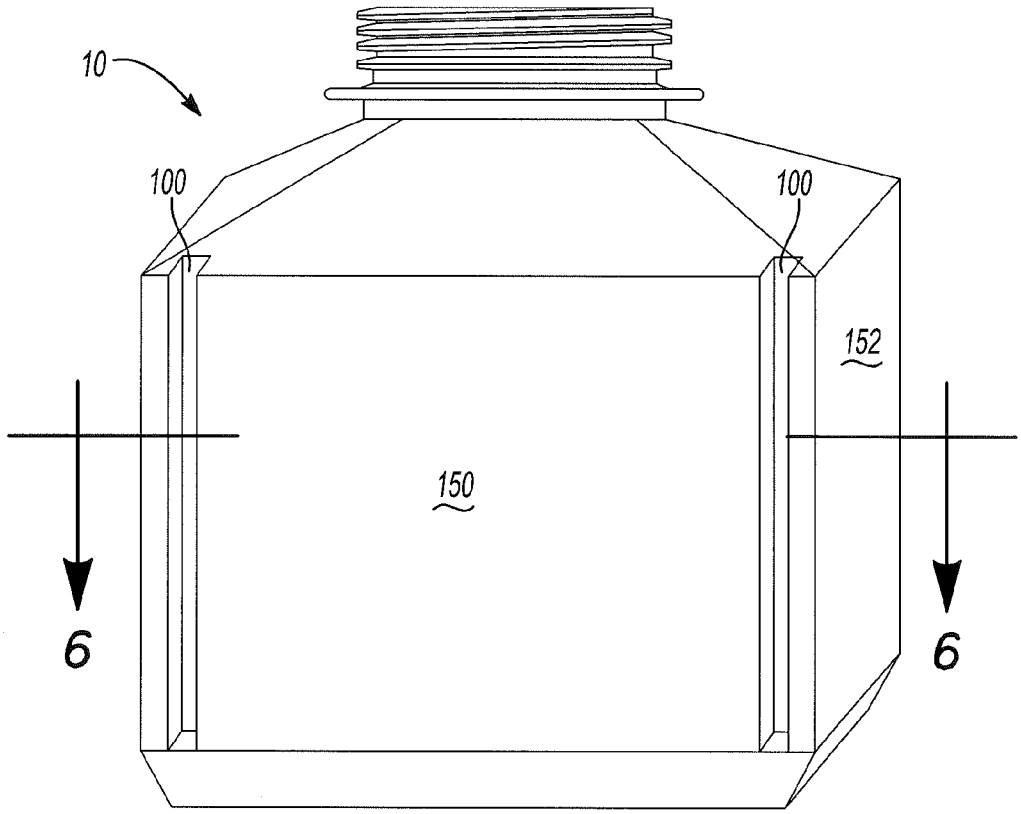
FIG. 5 is a front perspective view of an exemplary container incorporating the features of the present teachings.
Figure 6:
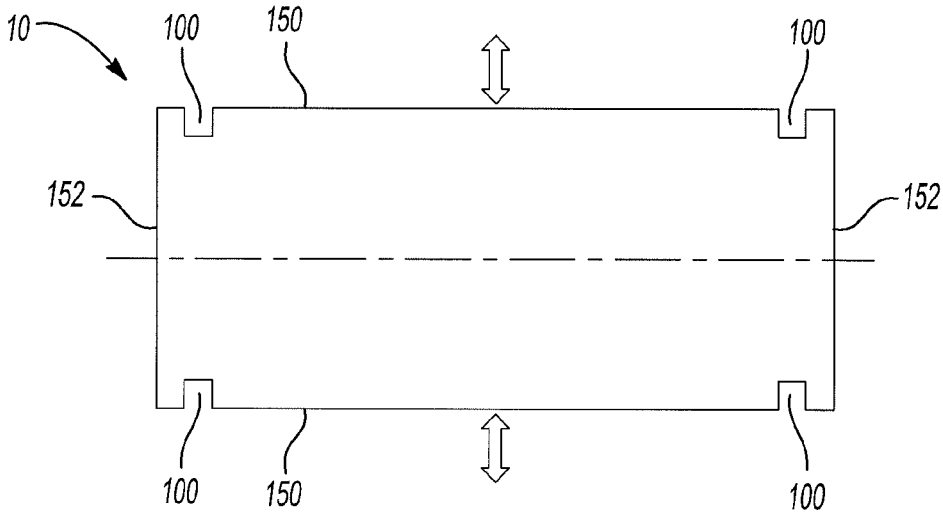
FIG. 6 is a cross-sectional view of the exemplary container of FIG. 5 incorporating the features of the present teachings.

Moreover, in some embodiments, it should be understood that ribs or seams 100 can be disposed in container 100 in a radial fashion such that the size and/or shape of the ribs or seams 100 is generally equal at each radial position about container 10 when viewed from above. Conversely, however, ribs or seams 100 can be disposed in container 100 in a non-uniform fashion, if desired. Still further, it should be understood that ribs and seams 100 can be disposed in mirrored relationship as illustrated in FIG. 4. Still further, ribs and seams 100 can be disposed such that a pair or more of ribs and seams 100 can be seen from opposing surfaces and concealed when viewed from adjacent opposing surfaces (see FIGS. 5 and 6).

In some embodiments, as illustrated in FIG. 4, inwardly directed channel 154 of ribs and seams 100 can define or include a generally arcuate surface 160. In some embodiments, arcuate surface 160 can define a radius that transitions from side 150 to an interior surface of outwardly directed portion 156.

Still further, in some embodiments as illustrated in FIG. 4, outwardly directed portion 156 can be coplanar with sides 152 and extend a distance such that distal tip 158 is generally even with a plane defined by at least a portion of adjacent side 150. Inwardly directed channel 154 can be formed as a radius extending from side 150 and terminating at an inner surface of outwardly directed portion 156.

In some embodiments, ribs or seams 100 can serve as a hinge feature permitting the articulation and/or movement of the interface between sides 150 and 152 in response to application of a force, e.g. vacuum force, loading force, use force, and the like.

As seen in FIG. 4, container 10 can further comprise transition lands 170 at opposing ends of ribs or seams 100. Specifically, in some embodiments, transition lands 170 can comprise a pair of mirrored surfaces inwardly directed relative to container 10. In some cases, transition lands 170 can each being generally triangularly shaped to provide transition between ribs or seams 100 and adjacent surfaces, such as portions of sidewall portion 24, shoulder portion 22, and/or base portion 28. Transition lands 170 can further provide structural reinforcement along ribs or seams 100 to further carry and then distributed carried forces.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A container comprising:

a finish;

a sidewall portion extending from said finish and including a first sidewall and a second sidewall;

a base portion extending from said sidewall portion and enclosing said sidewall portion to form a volume therein at an interior of the container for retaining a commodity;

a recess defined by the first sidewall at an exterior surface thereof that is opposite to the interior of the container, the recess extending longitudinally along the first sidewall; and at least one rib member extending longitudinally along said sidewall portion and partially defined by the recess of the first sidewall, the rib member extends away from the interior of the container, is coplanar with an outer surface of the second sidewall, and forms a portion of the second sidewall.

2. The container according to claim 1 wherein said rib member is formed as part of a molding flash component.

3. The container according to claim 1 wherein said rib member is formed using a side action mechanism in a mold.

4. The container according to claim 1 wherein said rib member is a seam of said sidewall portion.

5. The container according to claim 1 wherein said at least one rib member includes a distal end coplanar with the first sidewall.

6. The container according to claim 1 wherein said first sidewall and said second sidewall define an edge therebetween, said at least one rib member extending along at least a portion of said edge.

7. The container according to claim 6 wherein said at least one rib member includes a distal end, said at least one rib member extending along said second sidewall such that said distal end is generally even with a plane extending along said first sidewall.

8. The container according to claim 1, further comprising:

transition lands disposed at least one end of said at least one rib member, said transition lands distributing forces carried by said at least one rib member.

9. The container according to claim 1 wherein said at least one rib member is a hinge-like feature.

10. The container according to claim 1 wherein said at least one rib member is at least partially collapsible.

11. A container comprising:

a finish;

a base;

a sidewall portion between the finish and the base, the sidewall portion including a first sidewall and a second sidewall angled relative to the first sidewall;

an edge at an interface between the first and second sidewalls; and an outwardly directed rib member extending longitudinally along the first sidewall at the edge and extending away from an interior of the container, the outwardly directed rib member including a distal end that is generally coplanar with an outer surface of the second sidewall and forms a portion of the second sidewall.

12. The container of claim 11, wherein the first sidewall and the second sidewall are about 90° relative to one another.

13. The container of claim 11, wherein the rib member includes a longitudinally extending distal surface at the distal end, the distal surface is generally coplanar with a plane extending along the second sidewall.

14. The container of claim 11, wherein the second sidewall defines an inwardly extending arcuate surface that partially defines the rib member.

15. The container of claim 11, wherein the rib member is at a seam of the sidewall portion.

16. The container of claim 11, wherein the rib member is a collapsible hinge.

17. A container comprising:

a finish;

a base;

a sidewall portion between the finish and the base, the sidewall portion including a first sidewall and a second sidewall angled relative to the first sidewall;

an edge at an interface between the first sidewall and the second sidewall;

an outwardly directed rib member extending away from an interior of the container and extending longitudinally along the first sidewall at the edge, the rib member including a longitudinally extending distal portion that is coplanar with an outer surface of the second sidewall and forms a portion of the second sidewall; and an inwardly extending arcuate surface defined by the second sidewall proximate to the rib member and extending inward toward the interior of the container.

18. The container of claim 17, further comprising transition lands at opposite ends of the rib member.

* * * * *